US009027767B2

(12) United States Patent
Buckley et al.

(10) Patent No.: US 9,027,767 B2
(45) Date of Patent: May 12, 2015

(54) RACK SHELVING UNIT

(71) Applicant: Whirlpool Corporation, Benton Harbor, MI (US)

(72) Inventors: Thomas I. Buckley, Stevenville, MI (US); Mario D'Ovidio, Sevensville, MI (US); Michael J. Scherzer, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 72 days.

(21) Appl. No.: 13/662,820

(22) Filed: Oct. 29, 2012

(65) Prior Publication Data

US 2014/0116973 A1 May 1, 2014

(51) Int. Cl.

| | |
|---|---|
| ***A47F 5/00*** | (2006.01) |
| *A47B 47/02* | (2006.01) |
| *A47B 57/40* | (2006.01) |

(52) U.S. Cl.

CPC ..... *A47F 5/00* (2013.01); *A47B 47/021* (2013.01); *A47B 57/40* (2013.01)

(58) Field of Classification Search

CPC ..... A47F 5/00; A47B 7/00; A47B 7/40; A47B 47/021; A47B 47/022

USPC ..... 211/187, 189, 190–193; 108/106–107, 108/109–110, 180–181, 147.11–147.12, 108/147.14–147.15, 147.17; 248/235, 239, 248/250

See application file for complete search history.

(56) References Cited

U.S. PATENT DOCUMENTS

| | | | | | |
|---|---|---|---|---|---|
| 2,068,308 | A | * | 1/1937 | Zerver | 206/376 |
| 2,894,643 | A | * | 7/1959 | Maslow | 211/189 |
| 3,042,221 | A | * | 7/1962 | Rasmussen | 211/183 |
| 3,070,237 | A | * | 12/1962 | Fullerton et al. | 211/192 |
| 3,106,297 | A | * | 10/1963 | Schroeder | 211/192 |
| 3,273,720 | A | * | 9/1966 | Seiz | 211/192 |
| 3,294,250 | A | * | 12/1966 | Evans | 211/190 |
| 3,303,937 | A | * | 2/1967 | McConnell | 211/192 |
| 3,330,229 | A | * | 7/1967 | Ferdinand et al. | 108/107 |
| 3,346,126 | A | * | 10/1967 | Bloom et al. | 211/192 |
| 3,456,970 | A | * | 7/1969 | Sunasky | 403/319 |
| 3,463,325 | A | * | 8/1969 | Rogers et al. | 211/191 |
| 3,465,895 | A | * | 9/1969 | Miller | 211/191 |
| 3,475,044 | A | * | 10/1969 | Konstant | 403/217 |
| 3,545,626 | A | * | 12/1970 | Seiz | 211/192 |
| 3,587,483 | A | * | 6/1971 | Konstant | 108/157.13 |
| 3,589,746 | A | * | 6/1971 | Inglis et al. | 280/79.3 |
| 3,626,487 | A | * | 12/1971 | Seiz | 211/192 |
| 3,647,080 | A | * | 3/1972 | Denny | 211/191 |
| 3,913,498 | A | * | 10/1975 | Hall et al. | 108/186 |
| 3,936,024 | A | * | 2/1976 | Jung | 248/243 |
| 4,074,812 | A | * | 2/1978 | Skubic et al. | 211/192 |
| 4,078,664 | A | * | 3/1978 | McConnell | 211/189 |
| 4,113,110 | A | * | 9/1978 | Mittag | 211/191 |
| 4,796,541 | A | * | 1/1989 | Halstrick | 108/107 |
| 5,350,074 | A | * | 9/1994 | Rosenband | 211/192 |
| 5,463,966 | A | | 11/1995 | Nilsson | |
| 5,592,886 | A | * | 1/1997 | Williams et al. | 108/108 |
| 5,628,415 | A | * | 5/1997 | Mulholland | 211/189 |

(Continued)

*Primary Examiner* — Joshua J Michener
*Assistant Examiner* — Devin Barnett

(57) ABSTRACT

A rack shelving unit includes front and rear beams, and one or more tie bars extending between the front and rear beams to form a shelf frame with the front and rear beams which can support a shelf. The tie bar can include flexible sidewalls that can flex laterally away from each other as the shelf is loaded to increase the compressive force of a compression retainer coupling the tie bar to the front and rear beams.

19 Claims, 10 Drawing Sheets

(56) References Cited

U.S. PATENT DOCUMENTS

| | | | | |
|---|---|---|---|---|
| 5,769,249 | A | 6/1998 | Lascara | |
| 5,996,817 | A * | 12/1999 | Kao | 211/70.6 |
| 6,510,955 | B2 * | 1/2003 | Pellegrino | 211/192 |
| 6,679,379 | B1 * | 1/2004 | Kao | 206/349 |
| 6,732,989 | B1 * | 5/2004 | Kao | 248/309.1 |
| 6,776,298 | B2 * | 8/2004 | Courtwright | 211/191 |
| 6,820,758 | B2 * | 11/2004 | May et al. | 211/192 |
| 7,128,225 | B2 | 10/2006 | Saltzburg et al. | |
| 7,131,535 | B2 * | 11/2006 | Hernandez et al. | 206/349 |
| 7,252,202 | B2 | 8/2007 | Saltzberg et al. | |
| 7,357,262 | B2 * | 4/2008 | Fratilla | 211/117 |
| 7,753,216 | B2 * | 7/2010 | Kao | 211/70.6 |
| 8,172,098 | B2 * | 5/2012 | Eustace et al. | 211/191 |
| 8,381,920 | B2 * | 2/2013 | Chang | 211/70.6 |
| 8,443,992 | B2 * | 5/2013 | Lawson et al. | 211/190 |
| 8,733,564 | B2 * | 5/2014 | Fitzgerald et al. | 211/191 |
| 2001/0045404 | A1 * | 11/2001 | Pellegrino | 211/192 |
| 2002/0139766 | A1 * | 10/2002 | Courtwright | 211/191 |
| 2002/0153341 | A1 * | 10/2002 | May et al. | 211/192 |
| 2002/0158034 | A1 * | 10/2002 | Denny et al. | 211/189 |
| 2002/0195410 | A1 * | 12/2002 | Lin | 211/190 |
| 2003/0127407 | A1 * | 7/2003 | Gruber et al. | 211/189 |
| 2004/0007550 | A1 * | 1/2004 | Leeman et al. | 211/189 |
| 2004/0045921 | A1 * | 3/2004 | Muller | 211/187 |
| 2004/0079719 | A1 * | 4/2004 | Weaver et al. | 211/192 |
| 2004/0084394 | A1 * | 5/2004 | Powell | 211/192 |
| 2004/0084584 | A1 * | 5/2004 | Lin | 248/235 |
| 2004/0238470 | A1 * | 12/2004 | Wishart et al. | 211/189 |
| 2005/0061757 | A1 * | 3/2005 | Chiang | 211/70.6 |
| 2006/0157435 | A1 * | 7/2006 | Oberhaus et al. | 211/187 |
| 2007/0007156 | A1 * | 1/2007 | Wu | 206/376 |
| 2007/0023376 | A1 * | 2/2007 | Black | 211/187 |
| 2007/0102382 | A1 * | 5/2007 | Tuan Mu | 211/70.6 |
| 2007/0108147 | A1 * | 5/2007 | Chen | 211/187 |
| 2007/0119808 | A1 * | 5/2007 | Wishart et al. | 211/189 |
| 2008/0302743 | A1 * | 12/2008 | Chen | 211/70.6 |
| 2010/0084354 | A1 | 4/2010 | Eustace | |
| 2011/0220602 | A1 * | 9/2011 | Chen | 211/153 |
| 2012/0000871 | A1 | 1/2012 | Troyner et al. | |
| 2012/0091082 | A1 * | 4/2012 | Chang | 211/70.6 |
| 2013/0153521 | A1 * | 6/2013 | Kao | 211/70.6 |

* cited by examiner

RACK SHELVING UNIT

BACKGROUND

Rack shelving units are used for organizing and supporting loads in garages, workshops, and other areas requiring storage and organization. The shelving units have a variety of configurations, but commonly include an outer frame and one or more shelves attached to the outer frame. Typically, each shelf of the unit is used to support bulky or heavy loads, such as in the range of hundreds of pounds or more. Rack shelving units are usually packaged and sold in multiple pieces, and a user must assemble the rack shelving unit themselves using tools.

SUMMARY OF THE INVENTION

According to one aspect of the invention, a rack shelving unit comprises a front beam, a rear beam spaced rearward of the front beam, a tie bar extending between the front and rear beams to form a shelf frame with the front and rear beams and comprising a first sidewall and a second sidewall, a compression retainer coupling the tie bar to the front and rear beams with a compressive force, and having a first element provided on at least one of the first and second sidewalls and a second element provided on at least one of the front and rear beams, and a shelf supported on at least a portion of the shelf frame, wherein the first and second sidewalls are flexible, and are configured to flex laterally away from each other as the shelf is loaded to increase the compression of the first and second elements into each other and increase the compressive force of the compression retainer.

BRIEF DESCRIPTION OF THE DRAWINGS

The invention will now be described with respect to the drawings in which.

DESCRIPTION OF EMBODIMENTS OF THE INVENTION

Figure 1:
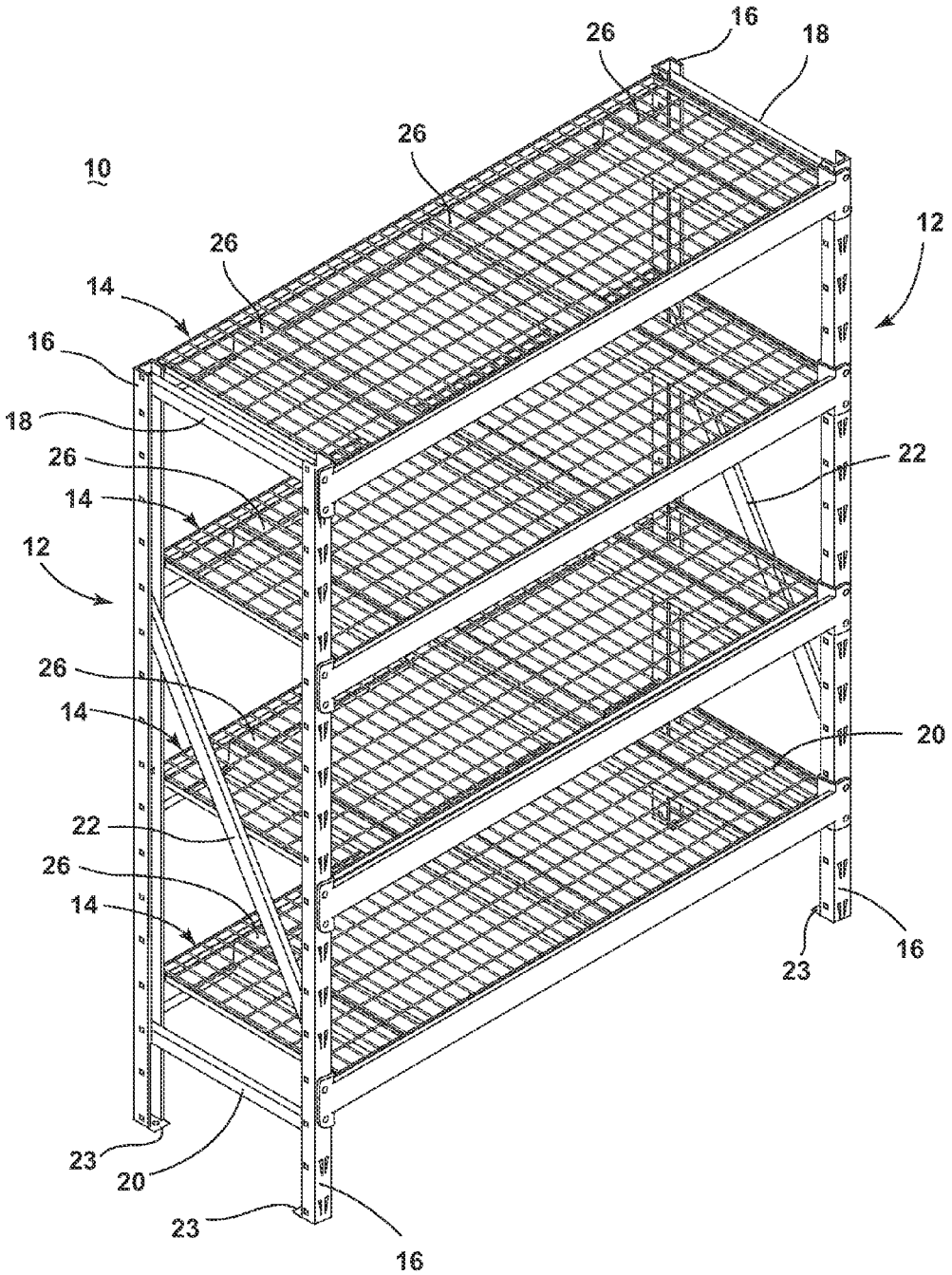
FIG. 1 is a perspective view of a rack shelving unit according to a first embodiment of the invention.

FIG. 1 is a perspective view of a rack shelving unit 10 according to a first embodiment of the invention. The rack shelving unit 10 includes spaced side frames 12 which support at least one shelf assembly 14 extending between the side frames 12. The particular configuration of the side frame 12 can vary in shape and proportion, but as shown herein, the side frame 12 includes spaced, upright frame supports 16 joined near their upper ends by an upper crossbar 18 and near their lower ends by a lower crossbar 20. The free ends of the upright frame supports 16 below the lower crossbar 20 can be configured to rest on a floor surface. A diagonal crossbar 22 can extend between the upright frame supports 16 at an angle between the upper and lower crossbars 18, 20 to add additional rigidity to the side frame 12. Plates 23 are provided on the lower end of the frame supports 16 and act as feet for supporting the side frame 12 on the floor surface. The upright frame supports 16, upper crossbar 18, lower crossbar 20, diagonal crossbar 22, and plates 23 can be welded together, such that each side frame 12 is a one-piece frame. Alternatively, the pieces of the side frame 12 can be attached together with mechanical fasteners, such as screws, blots, or tab/slot fasteners. Other variations of the side frame 12 can include other numbers or configurations of the upright frame supports 16 and crossbars 18, 20, 22.

Figure 2:
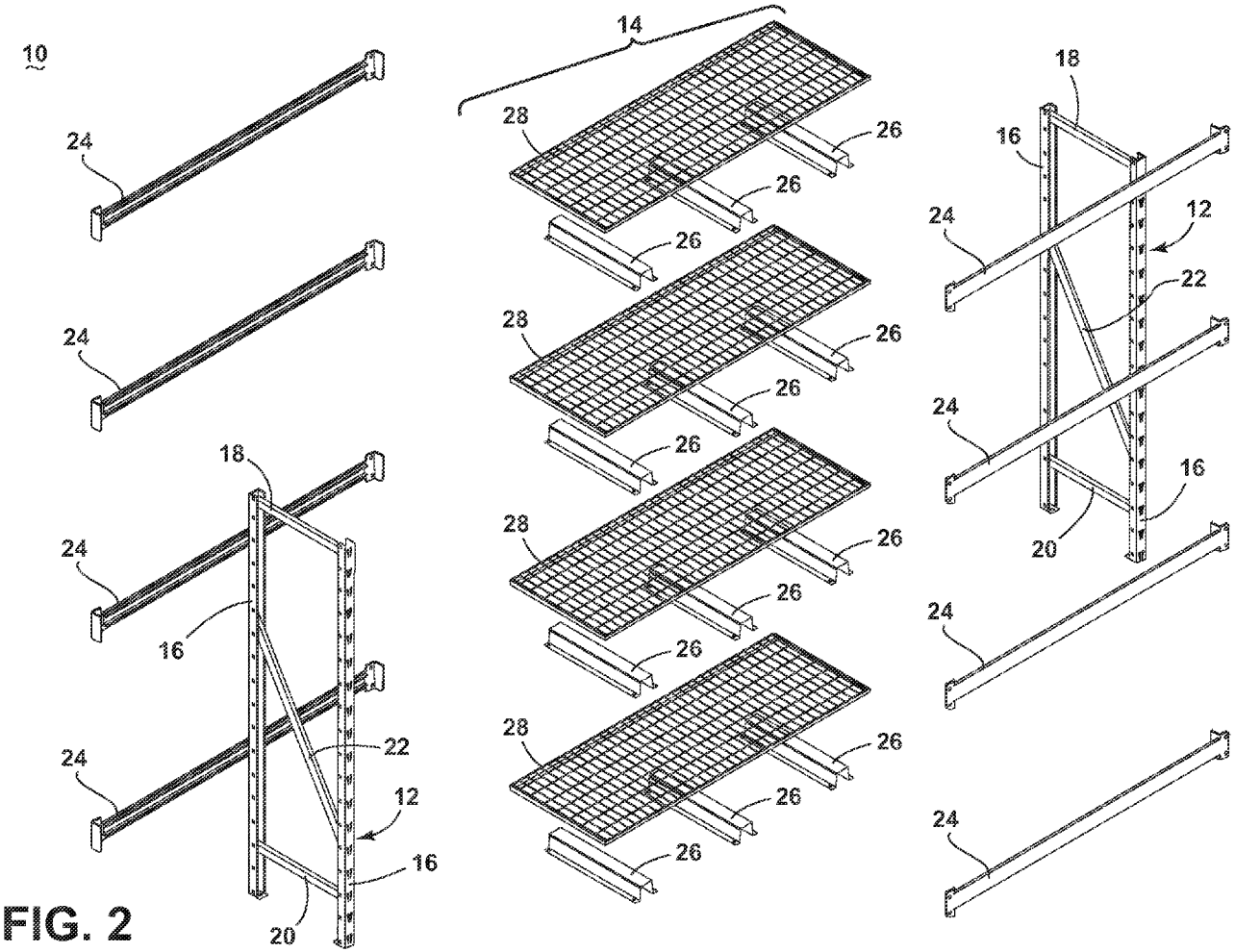
FIG. 2 is an exploded view of the rack shelving unit from FIG. 1.

FIG. 2 is an exploded view of the rack shelving unit 10 from FIG. 1. The shelf assembly 14 includes two spaced, shelf-supporting beams 24 extending between the upright frame supports 16 of opposing side frames 12, at least one tie bar 26 extending perpendicularly between the shelf-supporting beams 24, and a wire grid shelf 28 supported on the shelf-supporting beams 24 and at least one tie bar 26. The tie bar 26 is designed to tie the front and rear beams 24 together and provide support for the shelves 28. Together, the beams 24 and tie bar 26 can form a shelf frame which supports the shelf 28. Multiple shelf assemblies 14 can extend between the side frames 12. As shown herein, four spaced shelf assemblies 14 are provided, though other numbers of shelf assemblies 14 per rack shelving unit 10 are possible. Multiple tie bars 26 can be provided for each shelf assembly 14. As shown herein, three spaced tie bar 26 are provided, though other numbers of tie bars 26 per shelf assembly 14 are possible.

The rack shelving unit 10 can be manufactured from cold-formed/rolled, and welded structural steel component parts. The gauge steel can vary according to each component part; in one example, the side frames 12 can be manufactured from 16 gauge hot rolled steel ("HRS") or cold rolled steel ("CRS"), the plates 23 can be manufactured from 11 gauge HRS or CRS, the beams 24 can be manufactured from 14 gauge HRS or CRS, and the tie bars 26 can be manufactured from 20 gauge HRS or CRS. The shelves 28 can be zinc-coated steel.

Figure 3:
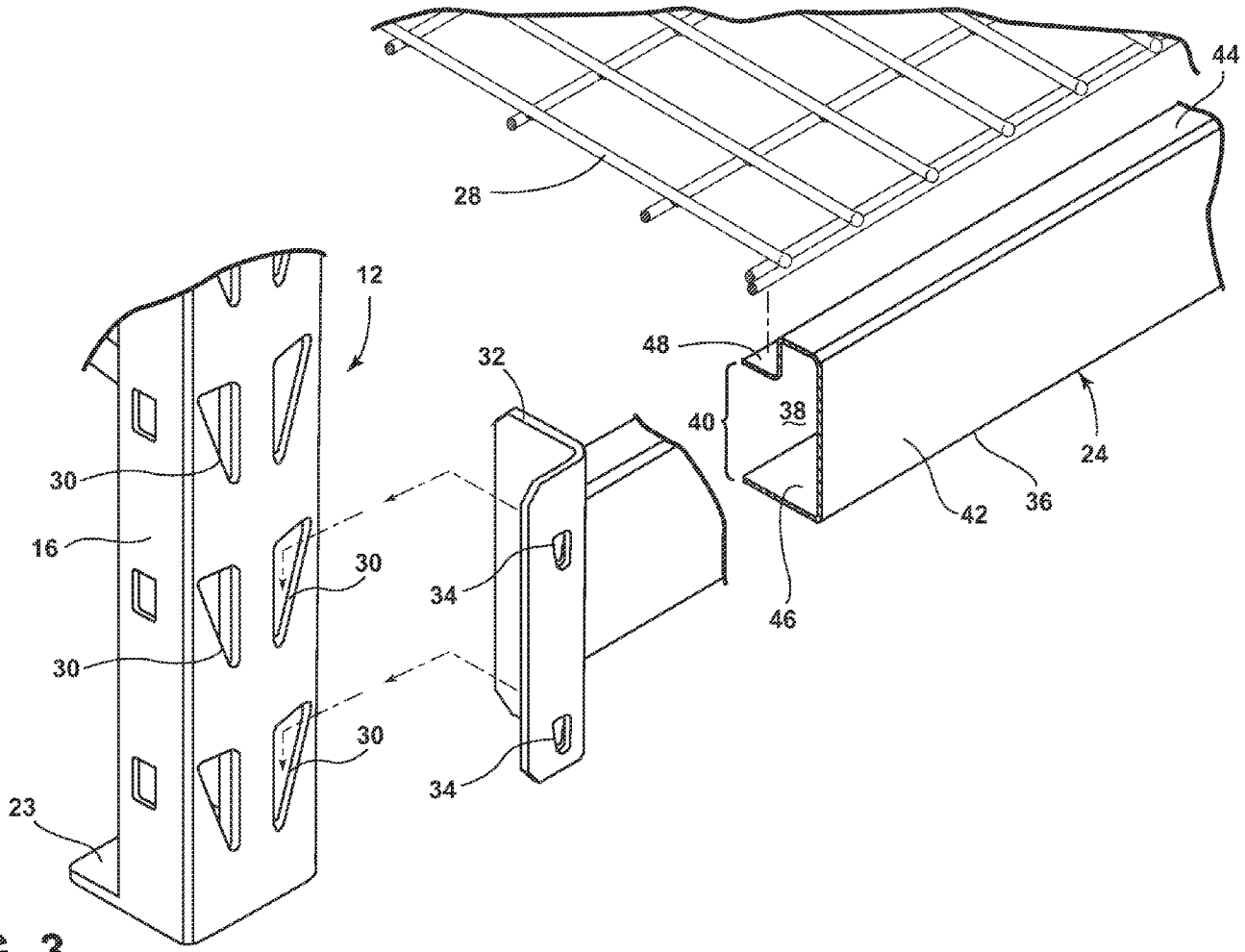
FIG. 3 is a close-up, exploded view of the coupling between a shelf-supporting beam, side frame, and shelf of the rack shelving unit from FIG. 1, with a portion of the shelf-supporting beam cut away for clarity.

FIG. 3 is a close-up, exploded view of the coupling between the shelf-supporting beam 24, the side frame 12, and the shelf 28, with a portion of the shelf-supporting beam 24 cut away for clarity. The position of the shelf-supporting beams 24 on the side frames 12 can be vertically adjustable, such that the shelf-supporting beams 24 can be positioned at different heights along the side frames 12. As shown herein, each upright frame support 16 can include multiple slots 30 extending along the length of the frame support 16. Two columns of opposing slots 30 can be provided in each upright frame support 16, so that the side frames 12 are universal. Each shelf-supporting beam 24 can include end brackets 32 having two spaced clip tabs 34 that are configured to be accommodated in the slots 30.

Each shelf-supporting beam 24 includes an elongated C-shaped body 36 extending between the end brackets 32 and defining a channel 38 having an opening 40. The C-shaped body 36 can include an outer bight 42, a top wall 44 extending from the bight 42, and a bottom wall 46 extending from the bight 42. The opening 40 can be oriented opposite the outer bight 42. The top wall 44 can include a shelf-supporting frame 48 formed by a downturned inner edge of the top wall 44, on which an outer edge of the shelf 28 can rest. The C-shaped body 36 can be made from HRS or CRS, and the end brackets 32 can be attached to the body 36 by welding.

Figure 4:
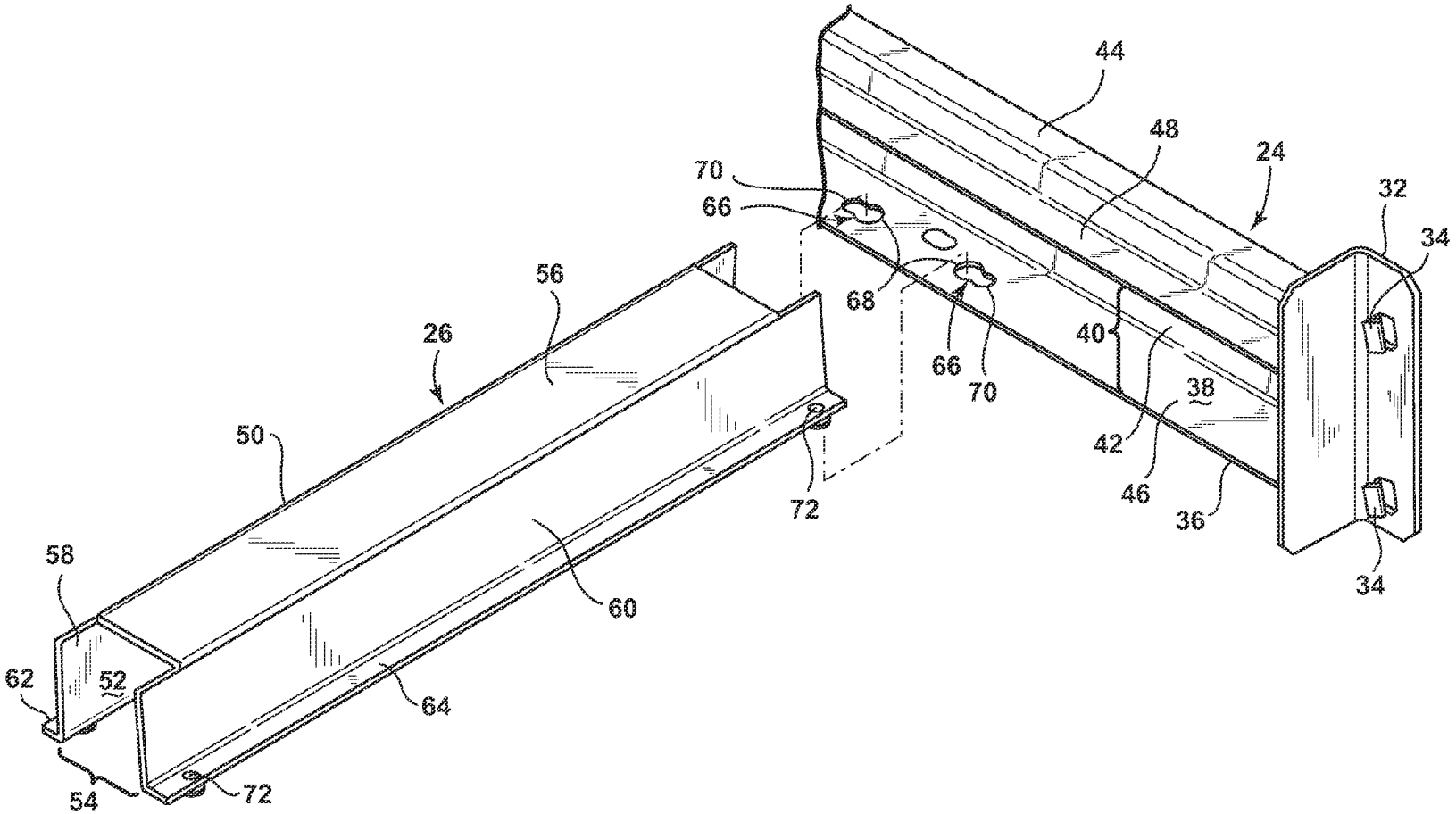
FIG. 4 is a close-up, exploded view of the coupling between a tie bar and the shelf-supporting beam of the rack shelving unit from FIG. 1, with a portion of the shelf-supporting beam cut away for clarity.

FIG. 4 is a close-up, exploded view of the coupling between the tie bar 26 and the beam 24, with a portion of the beam 24 cut away for clarity. The tie bar 26 can have an elongated U-shaped body 50 defining a channel 52 having an opening 54. When assembled, the tie bars 26 are oriented with their openings 54 facing downward, so that debris cannot collect in the channel 52.

The U-shaped body 50 can include a shelf-supporting bight 56, a first wall or side 58 depending from the bight 56, and a second wall or side 60 depending from the bight 56. The opening 54 can be oriented opposite the shelf-supporting bight 56. A first flange 62 extends from the free end of the first side 58, in a direction away from the opening 54. Likewise, a second flange 64 extends from the free end of the second side 60, in a direction away from the opening 54 and opposite the direction of the first flange 62. While the tie bar 26 is illustrated as having a U-shaped body 50, other cross-sectional configurations may be employed as well.

The first and second sides 58, 60 can be flexible, and can be configured to deflect laterally toward and away from each other relative to the bight 56. During assembly, the sides 58, 60 are elastically deflected such that they are squeezed and compressed toward each other, but will return to their undeflected state when unassembled. Also, during loading, the sides 58, 60 are elastically deflected such that they flex away from each other, but will return to their initial assembled state when unloaded.

At least one retainer can be used to fasten the tie bar to the beam 24. Optionally, the retainer can be a compression retainer coupling the tie bar 26 to the beam 24 with a compressive force. The compression retainer can have an element provided on the tie bar 26 and an element provided on the beam 24 that are selectively coupled together.

The element of the compression retainer provided on the beam 24 can include a pair of spaced keyhole slots 66 in the bottom wall 46 of the C-shaped body 36. Each keyhole slot 66 has a wide end or opening 68 and a narrow end or opening 70 connected to the wide opening 68, which together give the keyhole slot 66 a keyhole-shaped profile. The wide opening 68 has a larger diameter than the narrow opening 70. The paired keyhole slots 66 are mirror-images of each other, and are oriented in an opposing manner, such that the wide openings 68 are closest together. The number of paired keyhole slots 66 per beam 24 corresponds to the number of tie bars 26 per beam 24; in the illustrated embodiment, each beam 24 can have three sets of paired keyhole slots 66 equally spaced along the length of the beam 24. Each beam 24 therefore has six points of contact with the tie bars 26.

The other element of the compression retainer provided on the tie bar can include a compression retainer. In the illustrated embodiment, the compression retainer is a pin 72 which is received within the keyhole slot 66. The pins 72 can be mounted in an opening (not visible) in the flanges 62, 64, and two spaced pins 72 can be provided per flange 62, 64. The pins 72 can be configured to slide within the keyhole slots 66 on the beam 24. It is also within the scope of the invention for the location of the keyhole slots 66 and retainer openings to be reversed, such that the keyhole slots 66 are provided on the tie bar 26, and the retainer openings are provided on the beam 24, with pins 72 on the beam 24 configured to fit within the keyhole slots 66 on the tie bar 26.

Figure 5:
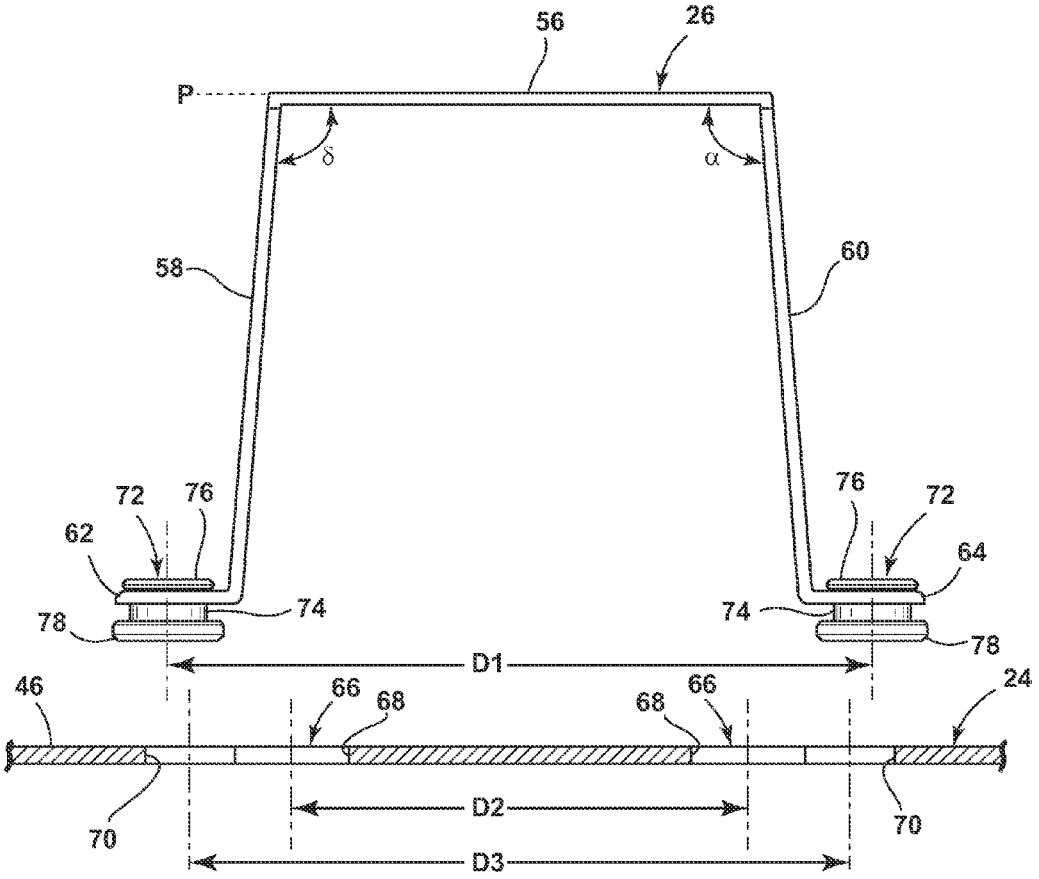
FIG. 5 is an exploded, partial sectional, side view of the coupling between the tie bar and the shelf-supporting beam of FIG. 4 with only a portion of the beam shown for clarity.

FIG. 5 is an exploded side view of the coupling between the tie bar 26 and the beam 24, with only a portion of the beam 24 shown for clarity. The sides of the U-shaped body 50 can be angled in order to control the direction of deflection under loading. As illustrated, the first side 58 depends from the bight 56 at an obtuse angle $\delta$ relative to a plane P defined by the bight 56, and the second side 60 depends from the bight 56 at an obtuse angle $\alpha$ relative to the plane P defined by the bight 56. The angles $\delta$ and $\alpha$ can be substantially equal to each other. One exemplary range for the angles $\delta$ and $\alpha$ is $95°\pm2°$.

Each pin 72 can include a semi-tubular body having a stepped diameter, with a smaller diameter neck 74 connecting larger diameter pin heads 76, 78. The pins 72 can be pre-assembled with the tie bar 26 by crimping one of the pins 72 near the corners of each flange 62, 64. The pins 72 can be pre-mounted on the tie bar 26, such that the pins 72 are carried by the tie bar 26 when a user begins assembly. In one example, the pins 72 can comprise rivets.

Each pin 72, wide opening 68, and narrow opening 70 has a centerline, and the distance between the pin centerlines D1 when not attached to the beam 24 can be greater than the distance between the wide opening centerlines D2. The distance between the pin centerlines D1 when not attached to the beam 24 can be approximately equal to or greater than the distance between the narrow opening centerlines D3.

Figure 6:
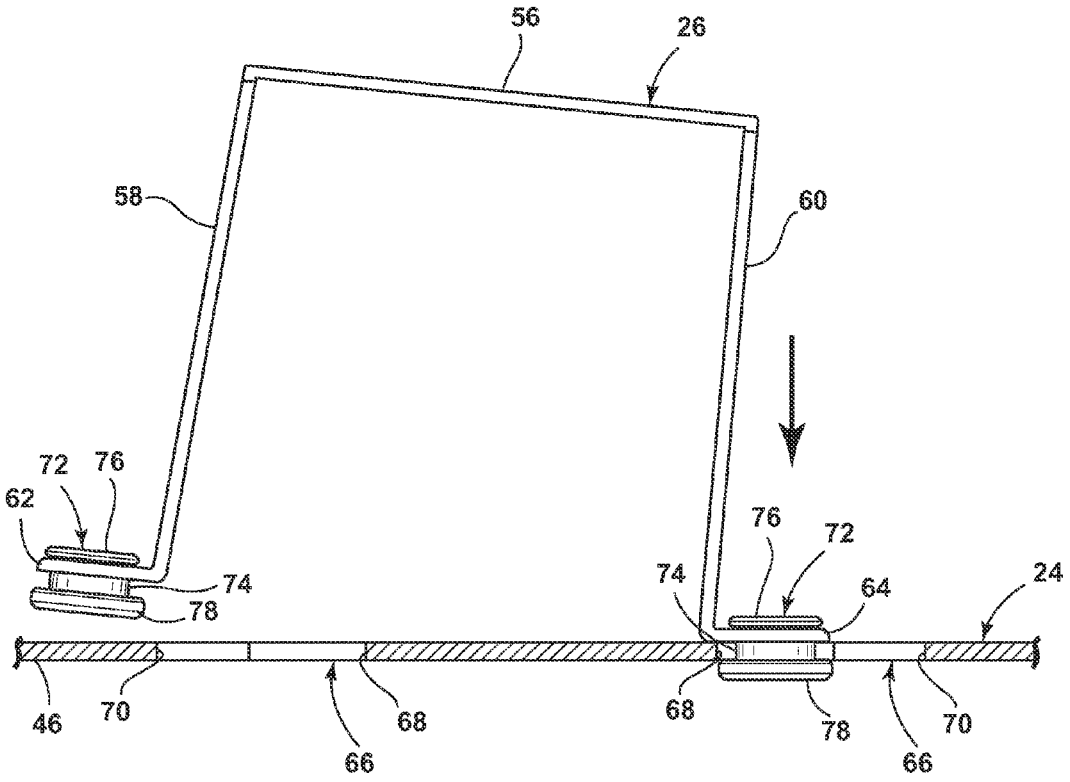
FIGS. 6-9 illustrate the assembly of the tie bar to the shelf-supporting beam.
Figure 7:
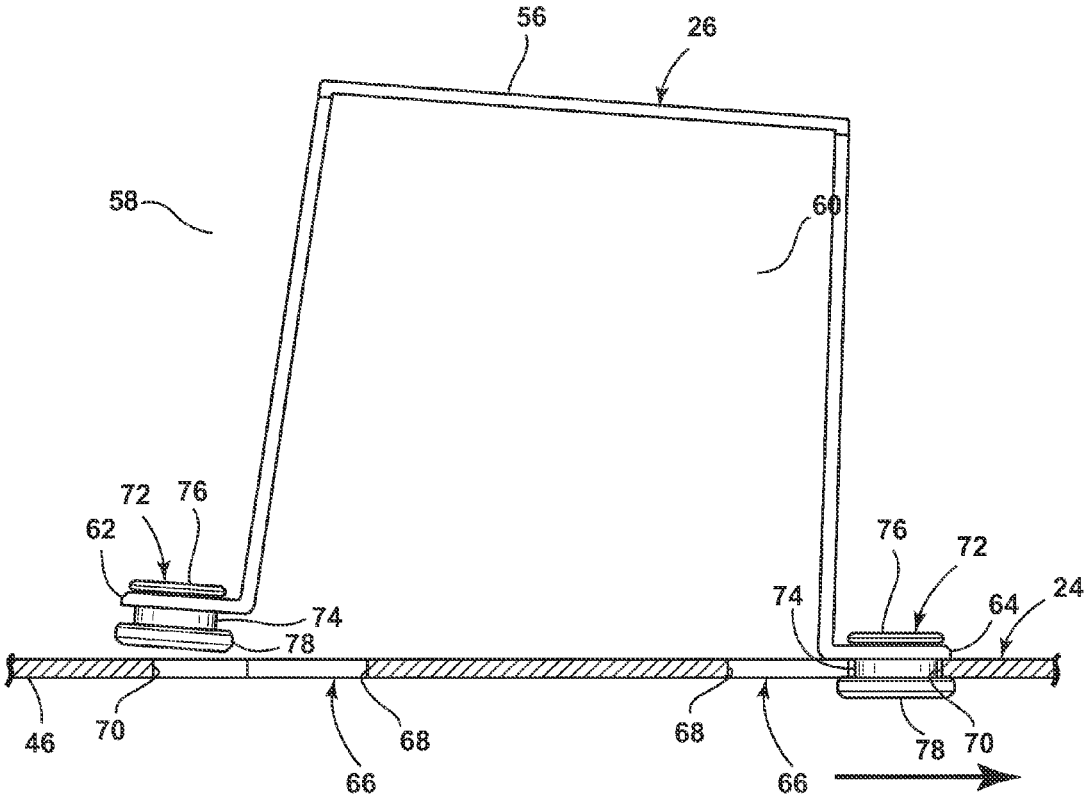
Figure 8:
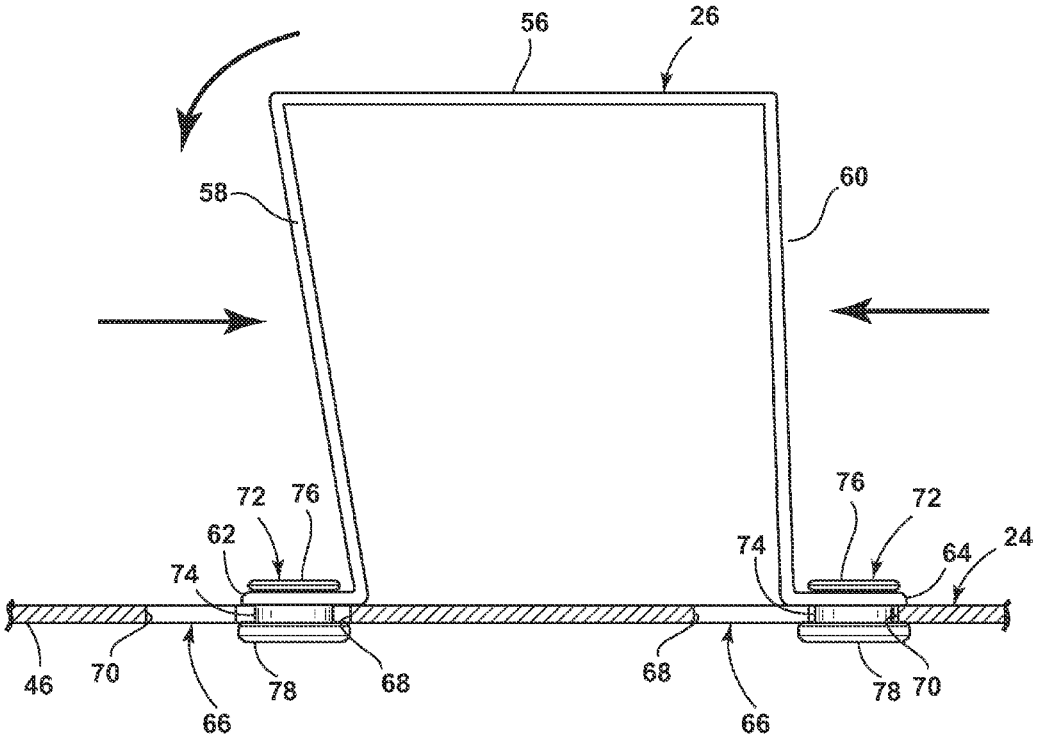
Figure 9:
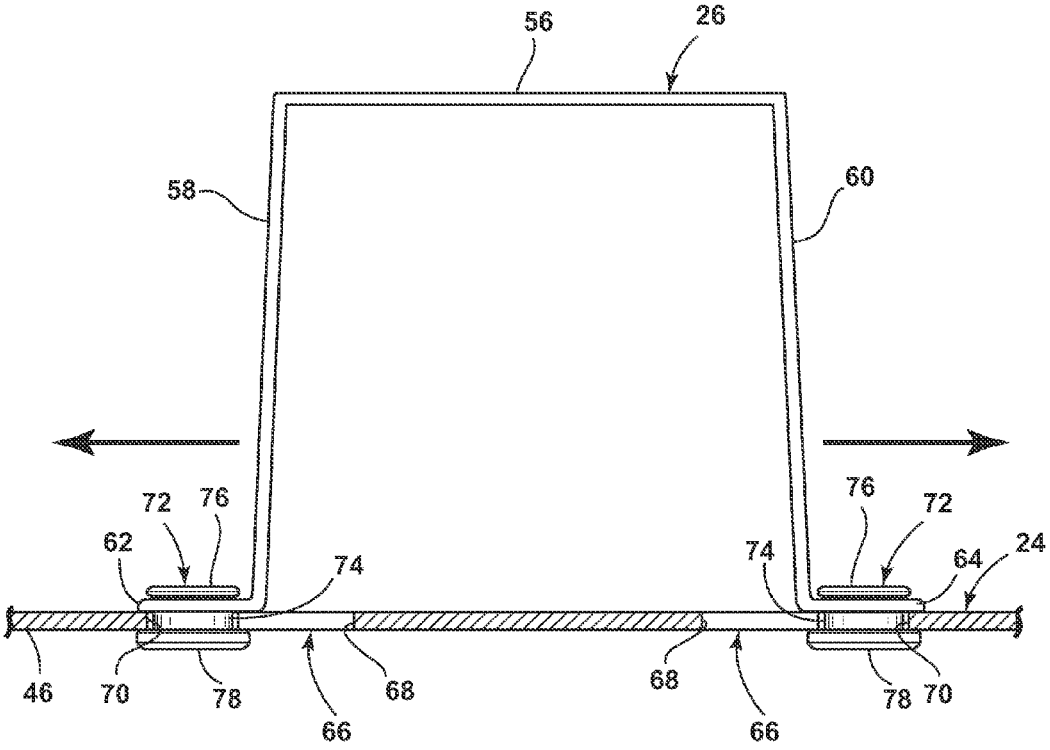

To assemble the rack shelving unit 10, the beams 24 are first mounted between the side frames 12 at a desired height, by inserting the clip tabs 34 on the end brackets 32 into the slots 30 on the upright frame supports 16, as shown in FIG. 3. Next, with reference to FIG. 6, to assemble one of the tie bars 26 to one of the beams 24, one of the pins 72 is inserted into the wide opening 68 of one of the keyhole slots 66 on the beam 24, until the lower pin head 78 clears the slot 66. The wide opening 68 of the keyhole slot 66 allows the lower pin head 78 to pilot through the keyhole slot 66, below the bottom wall 46 of the beam 24. Holding the tie bar 26 at a slight angle, the pin 72 is moved into the narrow opening 70 of the keyhole slot 66, such as until the pin 72 bottoms out in the keyhole slot 66, as shown in FIG. 7. The sides 58, 60 of the tie bar 26 are then compressed together, such as by a user squeezing the sides 58, 60 with one hand, and more particularly by squeezing the side 58, 60 with the free pin 72 toward the side 58, 60 with its pin 72 already inserted into the keyhole slot 66. The tie bar 26 is rotated about the inserted pin 72 to bring the free pin 72 toward the beam 24, as shown in FIG. 8. The other pin 72 is inserted into the wide opening 68 of the other keyhole slot 66, until the lower pin head 78 clears the slot 66. The sides 58, 60 of the tie bar 26 are then released, and the spring-force of the sides 58, 60 moving laterally outward drives each pin 72 into the narrow opening 70 of the corresponding keyhole slot 66, as shown in FIG. 9. The narrow opening 70 of the keyhole slot 66 traps the lower pin heads 78 and prevents the pins 72 from exiting the keyhole slot 66. After release, the tie bar 26 can assume its original profile, or can assume a slightly compressed profile, whereby the angles $\theta$ and $\alpha$ between the bight 56 and the sides 58, 60 are slightly smaller than in the original profile.

Figure 10:
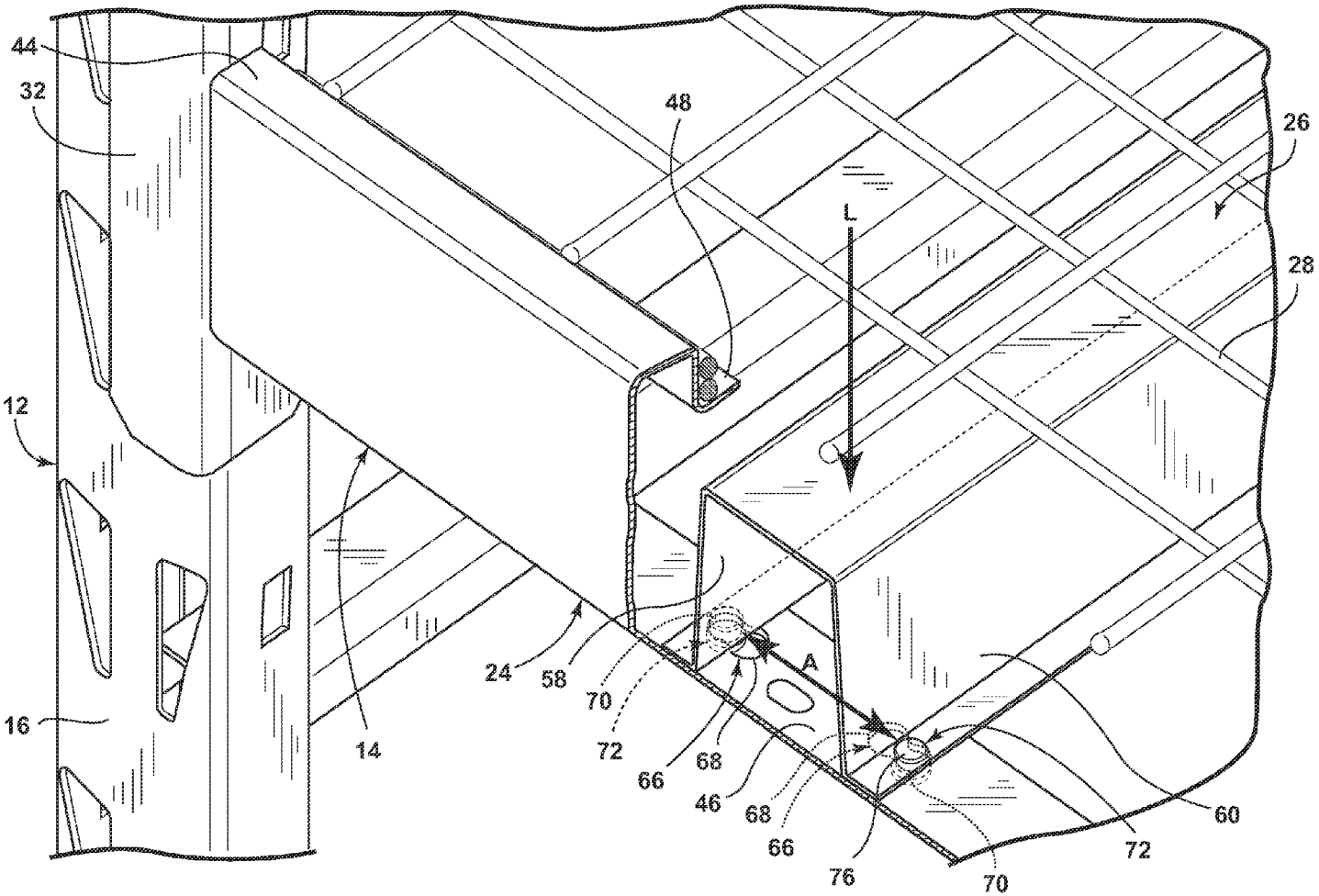
FIG. 10 is a close-up, perspective view illustrating a load being placed on a shelf of the rack shelving unit.

With reference to FIG. 10, after all the tie bars 26 are assembled to the beams 24 for one of the shelf assemblies 14, the shelf 28 is placed on the frame created by the assembled beams 24 and tie bars 26. As the shelf 28 is loaded, such as by a load L, the load L can further deflect the sides 58, 60 of the tie bars 26 to flex laterally away from each other, and to further drive the pins 72 into the narrow opening 70 of the corresponding keyhole slots 66, as indicated by doubled-ended arrow A. This action increases the compression of the pin 72 and keyhole slot 66 into each other and increases the compressive force of the compression retainer coupling the tie bar 26 to the beams 24. The downward force of the load L on the shelf 28 is distributed equally to the pins 72.

It is also contemplated that the assembly could proceed in other logical orders. For example, the sides 58, 60 can be compressed before inserting either pin 72, with both pins being inserted prior to releasing the sides 58, 60. In another example, after inserting one of the pins 72 into the wide opening 68 of one of the keyhole slots 66, an inserted pin can be manually slid into the narrow opening 70 of the keyhole slot 66, rather than waiting until the sides 58, 60 of the tie bar 26 are released. It is noted that the entire assembly of the rack shelving unit 10, including the coupling of the tie bars 26 to the shelf-supporting beams 24, can be accomplished without the use of tools. Optionally, a rubber mallet can be used to tap the clip tabs 34 on the beams 24 down into the slots 30 on the side frames 12.

The apparatus disclosed herein provides an improved rack shelving unit 10. In use, the rack shelving unit 10 shows improved performance in three areas: angular deflection of the beams, vertical deflection of the beams, and deflection of the shelf. When the rack shelving unit 10 is loaded by placing a load on one of the shelves 28, the force of the load imposes a rotational force on ends of the beams 24. However, the tie bars 26 prevent the beams 24 from rotating under the load, thereby reducing angular deflection of the beams 24. Simultaneously, as the shelf 28 is loaded, the beams 24 will deflect vertically, which greatly increases the load on the end brackets 32 that secure the beams 24 to the side frames 12. This vertical deflection is further influenced by the angular deflection of the beam 24. The fastening system of the rack shelving unit 10 reduces the effects of vertical deflection by providing greater support in the vertical plane via the heavy gauge steel construction and the use of multiple tie bars 26. Under load, the shelf 28 will also deflect and, without adequate support along the length of the shelf 28, can deform and subsequently fail. The fastening system of the rack shelving unit 10 can employ multiple tie bars 26 per shelf 28 to reduce shelf deflection and increase the load carrying capability along the entire length of the shelf 28.

Another advantage that may be realized in the practice of some embodiments of the described rack shelving unit is that two points of contact are provided between each tie bar 26 and beam 24 using the dual pin 72 fastening system. Some previous rack shelving units use only a single point of contact or fastener, typically a screw, to attach a tie bar to a beam. Thus, the single fastener receives the full force of loading which often leads to failure of the fastener. By using two fasteners, the force on each pin 72 is cut in half.

Another advantage that may be realized in the practice of some embodiments of the described rack shelving unit is that the entire rack shelving unit can be assembled without the use of tools. The simplified assembly is provided in part by the fastening system that secures the tie bars to the beams using the flexible tie bar and pin coupling. This translates to a substantial reduction in assembly time. Current methods for attaching tie bars to beams using screws can take an average of three minutes per tie bar, while the fastening method of the present invention can take only 15 seconds per tie bar.

Another advantage that may be realized in the practice of some embodiments of the described rack shelving unit is that the load capacity of the rack shelving unit 10 is increased by the use of stronger shelf assemblies 14. In one example, a rack shelving unit 10 with an overall size of approximately 77"×24"×72" (width×depth×height) can have a load capacity of approximately 2000 lbs. per shelf 28.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A rack shelving unit comprising:

a front beam;

a rear beam spaced rearward of the front beam;

a tie bar extending between the front and rear beams to form a shelf frame with the front and rear beams, wherein the tie bar has an inverted U-shaped body comprising a first sidewall, a second sidewall, and a bight connecting the first and second sidewalls, wherein the first sidewall and second sidewall are flexible; compression retainers coupling the tie bar to the front and rear beams with a compressive force, the compression retainers having a protruding element provided on each of the first and second sidewalls and keyhole slots provided on each of the front and rear beams; and a shelf resting upon the front beam and the rear beam;

wherein the tie bar has an unassembled state and an assembled state;

wherein the tie bar is prevented from being fastened to the front and rear beams in the unassembled state and is configured to be coupled to the front and rear beams when the first and second sidewalls are compressed by enabling the protruding elements to be inserted within the respective keyhole slots;

wherein the tie bar is prevented from being removed from the front and rear beams in the assembled state wherein the protruding elements can not be removed from the respective keyhole slots; and the tie bar is configured to be removed from the front and rear beams when the first and second sidewalls are compressed by enabling the protruding elements to be removed from the respective keyhole slots; and wherein in the assembled state, the first and second sidewall are configured to flex laterally away from each other as the shelf is loaded to increase the compression of the protruding elements and respective keyhole slots into each other and increase the compressive force of the compression retainers.

2. The rack shelving unit from claim 1, wherein the inverted U-shaped body defines a channel having an opening oriented away from the shelf.

3. The rack shelving unit from claim 2, wherein the first sidewall depends from the bight at a first obtuse angle relative to a plane defined by the bight, and the second sidewall depends from the bight at a second obtuse angle relative to the plane defined by the bight.

4. The rack shelving unit from claim 2, wherein the first sidewall comprises a first flange extending away from the opening and the second sidewall comprises a second flange extending away from the opening, wherein the first and second flanges abut each of the front and rear beams in the assembled state.

5. The rack shelving unit from claim 4, wherein the protruding elements comprise: a first pair of compression fasteners provided on the first flange; and a second pair of compression fasteners provided on the second flange.

6. The rack shelving unit from claim 1, wherein the keyhole slots comprise: a first pair of keyhole slots in the front beam; and a second pair of keyhole slots in the rear beam.

7. The rack shelving unit from claim 6, wherein the protruding elements comprise:

a first pair of fasteners slidably coupling the first sidewall of the tie bar to the first pair of keyhole slots; and a second pair of fasteners slidably coupling the second sidewall of the tie bar to the second pair of keyhole slots.

8. The rack shelving unit from claim 7, wherein corresponding fasteners are pre-fixed to the respective first and second sidewalls, and the first and second sidewalls are configured to flex laterally toward each other to fit the fasteners within the respective keyhole slots.

9. The rack shelving unit from claim 8, wherein the fasteners comprise rivets.

10. The rack shelving unit from claim 1, further comprising multiple tie bars extending between the front and rear beams to form the shelf frame.

11. The rack shelving unit of claim 1, wherein the tie bar has the same shape in the assembled state and the unassembled state.

12. The rack shelving unit of claim 1, wherein the tie bar is coupled to the front and rear beams without the use of tools.

13. A rack shelving unit comprising:

a front beam;

a rear beam spaced rearward of the front beam;

a tie bar, the tie bar having an inverted U-shaped body comprising a bight and a pair of flexible sidewalls extending from the bight, and configurable between an unassembled state, a compressed state wherein the sidewalls are compressed toward each other, an assembled state, and a loaded state wherein the flexible sidewalls are flexed away from each other, and wherein the tie bar is coupled with and extends between the front and rear beams to form a shelf frame with the front and rear beams;

compression retainers coupling the tie bar to the front and rear beams with a compressive force, the compression retainers each having a protruding element provided on each of the first and second sidewalls and keyhole slots provided on each of the front and rear beams;

wherein the tie bar is prevented from being fastened to the front and rear beams in the unassembled state, and prevented from being removed from the front and rear beams in the assembled state wherein the protruding elements can not be removed from the respective keyhole slots;

wherein the tie bar is coupled to the front and rear beams when in the compressed state by enabling the protruding elements to be inserted within the respective keyhole slots, and is removed from the front and rear beams when in the compressed state by enabling the protruding elements to be removed from the respective keyhole slots;

wherein the flexible sidewalls are flexed away from each other when a load is applied to the bight.

14. The rack shelving unit of claim 13, wherein the shape of the tie bar is the same in the assembled state and the unassembled state.

15. The rack shelving unit of claim 13, wherein the tie bar is coupled to the front and rear beams without the use of tools.

16. The rack shelving unit from claim 13, wherein the keyhole slots comprise:

a first pair of keyhole slots in the front beam; and a second pair of keyhole slots in the rear beam.

17. The rack shelving unit from claim 6, wherein the protruding elements comprise:

a first pair of fasteners slidably coupling the first sidewall of the tie bar to the first pair of keyhole slots; and a second pair of fasteners slidably coupling the second sidewall of the tie bar to the second pair of keyhole slots.

18. The rack shelving unit from claim 7, wherein corresponding fasteners are pre-fixed to the respective first and second sidewalls, and the first and second sidewalls are configured to flex laterally toward each other to fit the fasteners within the respective keyhole slots.

19. The rack shelving unit from claim 13, further comprising multiple tie bars extending between the front and rear beams to form the shelf frame.

* * * * *